United States Patent [19]

Hayes

[11] 4,347,981

[45] Sep. 7, 1982

[54] TURRET TYPE SPRINKLER WITH IMPROVED TURRET ASSEMBLY

[75] Inventor: Jerry R. Hayes, Peoria, Ill.

[73] Assignee: L. R. Nelson Corporation, Peoria, Ill.

[21] Appl. No.: 194,605

[22] Filed: Oct. 6, 1980

Related U.S. Application Data

[63] Continuation of Ser. No. 20,925, Mar. 15, 1979, abandoned.

[51] Int. Cl.[3] ..... B05B 1/16

[52] U.S. Cl. ..... 239/394; 239/498; 239/500; 239/DIG. 1; 239/DIG. 7

[58] Field of Search ..... 239/394, 396, 460, 498, 239/500, 521-524, 590.3, 600, DIG. 1, DIG. 7

[56] References Cited

U.S. PATENT DOCUMENTS

| | | | |
|---|---|---|---|
| 630,468 | 8/1899 | Quayle . | |
| 1,881,409 | 10/1932 | Le Moon . | |
| 2,631,889 | 3/1953 | Johnson | 299/18 |
| 2,990,123 | 6/1961 | Hyde | 239/453 |
| 3,081,950 | 3/1963 | Rinkewich | 239/394 |
| 3,516,611 | 6/1970 | Piggott | 239/391 |
| 3,596,835 | 8/1971 | Smith | 239/394 |
| 3,814,326 | 6/1974 | Bartlett | 239/276 |
| 3,998,390 | 12/1976 | Peterson | 239/394 |
| 4,043,511 | 8/1977 | Nakamara | 239/394 |
| 4,055,301 | 10/1977 | Hruby, Jr. | 239/394 |

FOREIGN PATENT DOCUMENTS

| | | |
|---|---|---|
| 490102 | 1/1953 | Canada . |
| 786492 | 6/1935 | France . |
| 288055 | 8/1931 | Italy . |

*Primary Examiner*—Bruce H. Stoner, Jr.
*Assistant Examiner*—Michael J. Forman
*Attorney, Agent, or Firm*—Cushman, Darby & Cushman

[57] ABSTRACT

A turret type sprinkler comprising a base having inlet hose fitting for connection with a hose communicating with a source of water under pressure and a turret assembly mounted on the base for indexed rotational movement about a generally vertical axis. The turret assembly includes upper and lower cooperating annular members fixedly secured in cooperating relation providing a plurality of spray head structures spaced annularly about the axis of indexed rotation thereof. Each of the spray head structures includes a water inlet extending upwardly from a downwardly facing annular surface on the lower annular member in a position to be communicated with a water outlet on the base in one operative position of indexed rotation. Each of the spray structures also includes upwardly open pattern defining surfaces formed in the upper annular member and extending upwardly and outwardly with respect to the associated water inlet, and a water spreading element for spreading the water from the inlet onto the pattern defining surfaces.

21 Claims, 8 Drawing Figures

TURRET TYPE SPRINKLER WITH IMPROVED TURRET ASSEMBLY

This is a continuation, of application Ser. No. 20,925 filed Mar. 15, 1979, now abandoned.

This invention relates to sprinklers and more particularly to improvements in sprinklers of the turret type.

Turret type sprinklers have been proposed in the patented literature for many, many years and have been available commercially for many years. An exemplary embodiment of a sprinkler of the turret type in the expired prior art is disclosed in U.S. Pat. No. 630,468 dated Aug. 8, 1899. A disclosure of a turret type lawn sprinkler which has been commercially available for quite some time is contained in U.S. Pat. No. 3,081,950 dated Mar. 19, 1963. A more recent patent disclosing a turret type sprinkler is U.S. Pat. No. 3,814,326 dated June 4, 1978. Related turret type devices, such as turret type hose or spray nozzles, are disclosed in U.S. Pat. No. 3,516,611 and No. 3,596,835; and turret type shower heads are disclosed in U.S. Pat. No. 3,998,390 and No. 4,043,511.

In all of these devices the stream which is discharged from the turret head is defined essentially by an aperture or a series of apertures. Variation in the pattern of each spray head structure provided by the turret is determined by the configuration of the aperture or apertures provided. By utilizing apertures to define the stream which serves to achieve the ground pattern of the particular spray head structure, considerable limitation as to the nature of the pattern or the construction of the spray head structure is provided. For example, in U.S. Pat. No. 630,463 the turret head consists essentially of a flat circular plate with each spray head structure being formed as drilled holes in the plate except for the provision of a separate revoluble spray disc. In the more recent U.S. Pat. No. 3,081,950, each spray head structure is formed as a thin dome shaped element mounted on a turntable turret body, each dome shaped structure having apertures therein of a size and shape such as to define the ground pattern. U.S. Pat. No. 3,814,326 provides different shape and sized apertures in a molded plastic turret member, one of the spray head structures of the turret head consisting essentially of an annular opening, the exterior periphery of which is defined by a frustoconical surface molded in the turret head and the interior periphery of which is defined by a frustoconical surface of a separate element having a stem portion 51 adapted to snap within a central opening in the inlet.

While the turret type sprinklers of the prior art have proven to be satisfactory in operation, there is always the need to provide an improved structure which can achieve results similar to that achieved by the prior art with less cost and to provide an improved structure which can achieve improved performance.

It is an object of the present invention to provide an improved turret type sprinkler which meets the above-described needs. In accordance with the principles of the present invention, this objective is obtained by providing a turret assembly in which the spray head structures are provided by cooperating upper and lower annular members. The lower annular member provides a downwardly facing planar annular surface having a plurality of annularly spaced inlets extending upwardly therefrom which form the inlets of the spray head structures. The exterior annular member has formed integrally therein upwardly open pattern defining surfaces which extend upwardly and outwardly with respect to the associated water inlet means. The pattern defining surfaces for each spray head structure are different so that the ground pattern desired can be selected by moving the turret assembly into an operative indexed position of rotation with respect to a base corresponding to the desired spray head structure. The base has an inlet hose fitting for connection with a hose communicating with a source of water under pressure and a water outlet disposed in water communicating relation with the inlet hose fitting for directing a source of water communicated with the latter in an upward direction at the operative position in sealed relation with the downwardly facing annular surface provided on the lower annular member.

Preferably, each spray head structure includes a water spreading element for spreading the water flowing upwardly through the associated water inlet onto the associated upwardly open and upwardly and outwardly extending pattern defining surfaces. The water spreading element may be formed as an integral part of the upper annular member, an integral part of the lower annular member, or by a separate element. A plurality of different ground patterns is thus provided, such as circular, semi-circular, square, rectangular and strip. The teachings with respect to the plurality of spray head structures embodied in the turret type sprinkler of the present invention are applicable to single fixed spray head structures and hence it is an object of the present invention to provide improvements in spray head structures of that type as well.

Preferably, the cooperating upper and lower annular members forming the turret assembly are molded of plastic material and provided with integral means for fixedly securing the same in their operative position. Such means preferably comprises an annular rim extending upwardly from the exterior periphery of the lower annular member and an annular skirt extending downwardly from the exterior periphery of the upper annular member, the skirt being provided with integral locking lugs which engage within a downwardly facing annular groove formed below the annular rim.

A further object of the present invention is to provide a turret type sprinkler of the type described which is simple in construction, economical to manufacture and effective in operation.

These and other objects of the present invention will become more apparent during the course of the following detailed description and appended claims.

The invention may best be understood with reference to the accompanying drawings, wherein an illustrative embodiment is shown.

Figure 1:
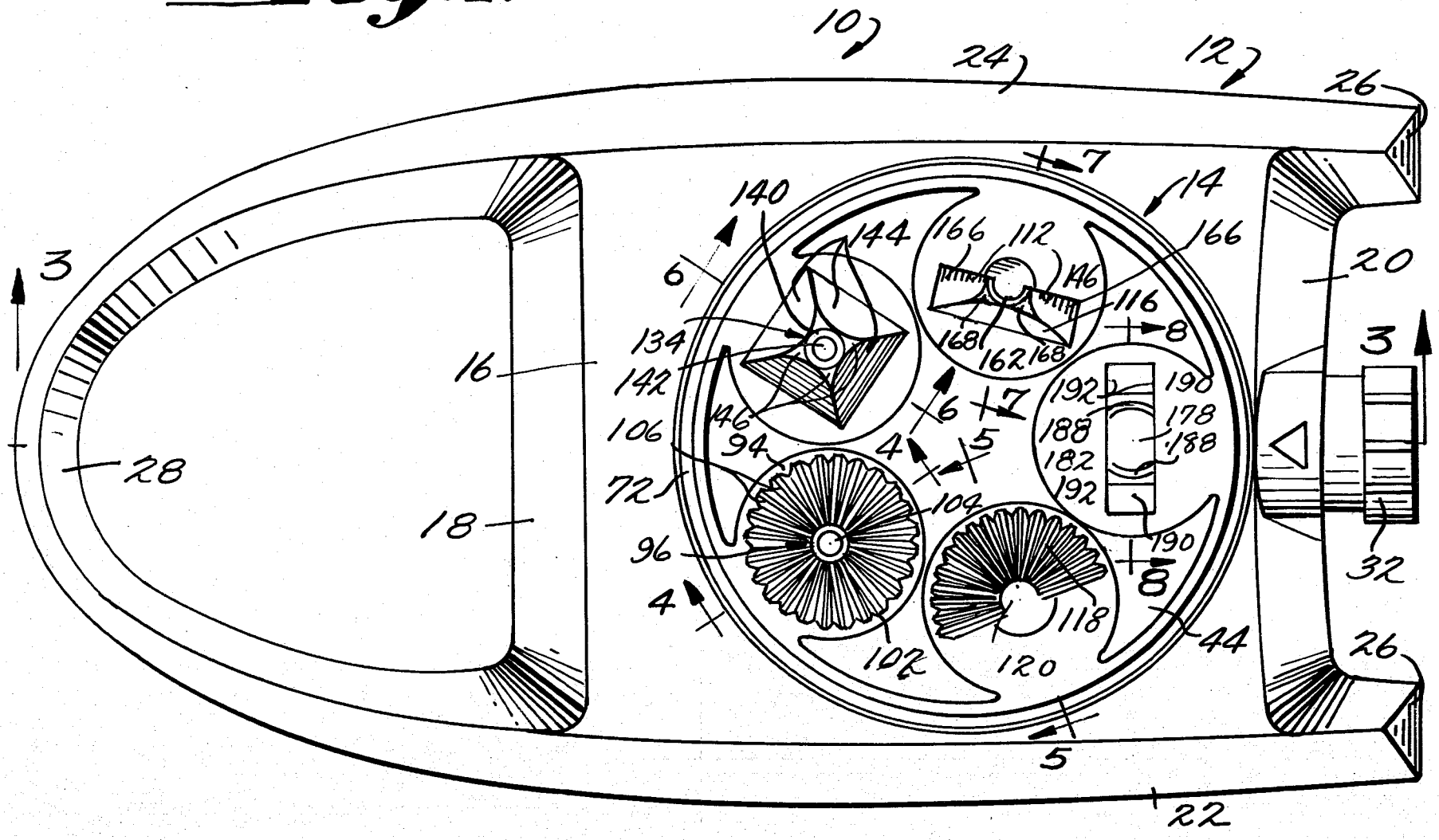
FIG. 1 is a top plan view of a turret type sprinkler embodying the principles of the present invention.
Figure 2:
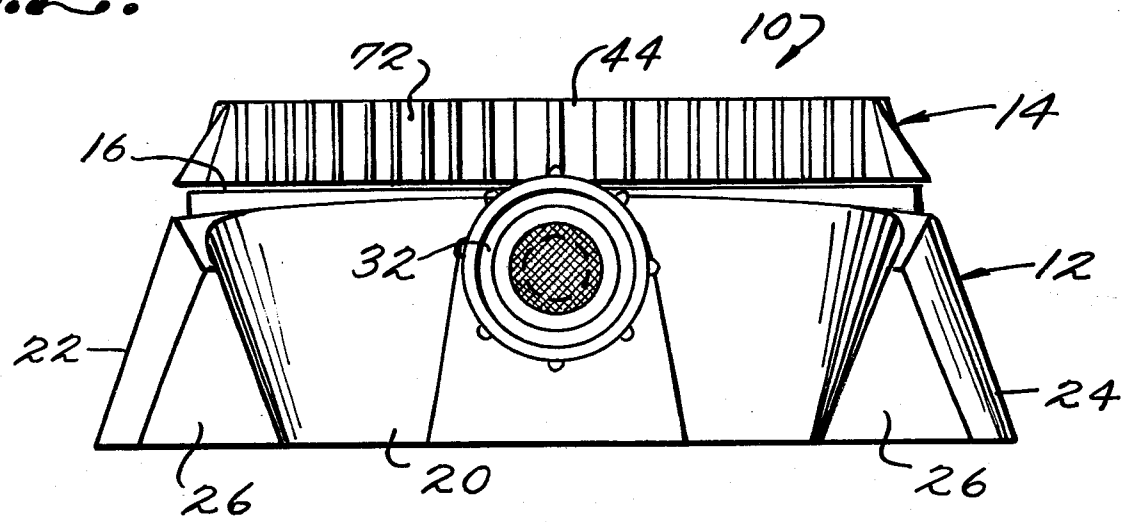
FIG. 2 is an end view of the sprinkler shown in FIG. 1.

Referring now more particularly to the drawings, there is shown therein a sprinkler, generally indicated at 10, which embodies the principles of the present invention. The sprinkler 10 includes a base, generally indicated at 12, and a turret assembly, generally indicated at 14. Preferably, both the base 12 and turret assembly 14 are formed of plastic material, a preferred material being ABS (e.g. CYCOLAC®). It will be understood, however, that other plastic materials may be utilized if desired. Preferably, the base 12 constitutes essentially a one-piece molding, whereas the turret assembly 14 constitutes essentially an assembly formed of two separate molded components.

The base 12 is molded to include an upper generally horizontally extending rectangular shaped base wall portion 16 having front, rear and side wall portions 18, 20, 22 and 24 respectively extending downwardly from the periphery thereof. The junctures between the rear wall 20 and each of the side walls 22 and 24 are formed into rearward extensions, indicated generally at 26. The extensions 26 when viewed in plan define the rear ends of runners or skids for the base. The junctures between the front wall portion 18 and each side wall portion 22 and 24 extend forwardly and toward one another so as to define a handle section 28 simulating the front end of a runner or skid.

Formed in the central portion of the rear wall portion 20 is an annular wall portion defining an inwardly extending opening 30. Mounted within the rear end portion of the opening 30 is a female hose fitting 32 which constitutes a water inlet for the sprinkler. In accordance with usual practice, the female fitting 32 is configured to be connected with the male fitting on one end of a hose (not shown), the opposite end of which is communicated with a source of water under pressure. The inner end of the opening 30 communicates with a vertically extending opening 34 formed in a horizontally extending annular wall 36 spaced below the main rectangular horizontal wall portion 16 of the base. Extending upwardly from the horizontally extending annular wall 36 is a cylindrical wall 38 which defines a water outlet of the base 12. The vertical axis of the cylindrical wall 38 is parallel with a vertical axis of a cylindrical hub portion 40 formed integrally in the center of the rectangular wall portion 16. The majority of the hub portion extends downwardly from the rectangular wall portion 16 and this depending section is rigidified by suitable strengthening ribs 42.

The turret assembly 14, as previously indicated, consists essentially of two main components. As shown, these components include an upper annular member 44 and a lower annular member 46. The turret assembly 14 is mounted on the base for indexed rotational movement about a vertically extending axis and provides a plurality of spray head structures which, when communicated with a source of water under pressure, are operable to distribute the water onto the ground in a plurality of different ground patterns. The number of different spray head structures is equal to the number of indexed positions of rotation so that each spray head structure has a single index position of rotation in which the water from the outlet of the base is disposed in operative relation with the associated spray head structure.

The indexed rotational mounting of turret assembly 14 on the base 12 is accomplished, as shown, by forming an integral splined shaft portion 48 in depending relation to the central section of the upper annular turret member 44. Integral shaft portion 48 extends into the base hub portion 40 and defines the rotational axis of the turret assembly with respect to the base. The shaft is retained within the hub portion by any suitable means such as a bolt 50 extending through a washer 52 and into the lower end of the shaft portion 48, the washer extending beneath the lower end of the hub portion 40.

The index function of the rotational mounting of the turret assembly 14 is provided by a plurality of radially inwardly facing notches 54 formed in an annular skirt 56 extending downwardly from the upper annular member 44 in concentric relation with the shaft portion 48. The base 12 has formed integrally on the upper horizontal wall portion 16 thereof a pair of short, parallel wall sections 58 which extend outwardly from the upper extension of the hub portion 40. The wall sections 58 define a space within which is received a coil spring 60 which serves to resiliently bias a detent 62 into an aligned notch 54. It will be understood that other indexing arrangements can be provided. For example, in lieu of the radially extending spring and ball index arrangement, the spring and ball could be mounted on the base so as to extend vertically in a position with respect to the rotational axis diametrically opposed to the outlet 38 in a manner similar to the index arrangement disclosed in the aforesaid U.S. Pat. No. 3,081,950, the disclosure of which is hereby incorporated by reference herein.

The lower annular member 46 provides a downwardly facing planar annular surface 64, the interior and exterior peripheries of which are defined by the interior and exterior peripheries of the annular member. In order to provide for the fixed securement of the upper annular member 44 in operative relation with the lower annular member 46, the latter has formed on the exterior periphery thereof an upwardly extending rim 66. The rim provides an exterior frustoconical surface 68 in the upper section thereof and an annular groove 70 in the lower section thereof. The upper annular member 44 has an annular skirt 72 extending downwardly from the exterior periphery thereof in surrounding relation to the rim 66 when the two annular members are disposed in operative relation. Formed on the lower inner periphery of the skirt 72 is a series of annularly spaced locking lugs or ridges 74 adapted to enter the annular groove 68 of the lower annular member 46 when the two annular members are disposed in operative position. The arrangement is such that the two annular members can be brought together into their operative position by a relative axial movement during which the annular ridges 74 ride on the frustoconical surfaces 68 until they snap over the latter into the annular groove 70.

As previously indicated, the turret assembly 14 provides a plurality of annularly spaced spray head structures, any one of which can be brought into operative relation with respect to the outlet 38 by moving the turret assembly into an associated indexed position of rotation wherein the inlet of the spray head structure is disposed over the outlet 38.

Figure 3:
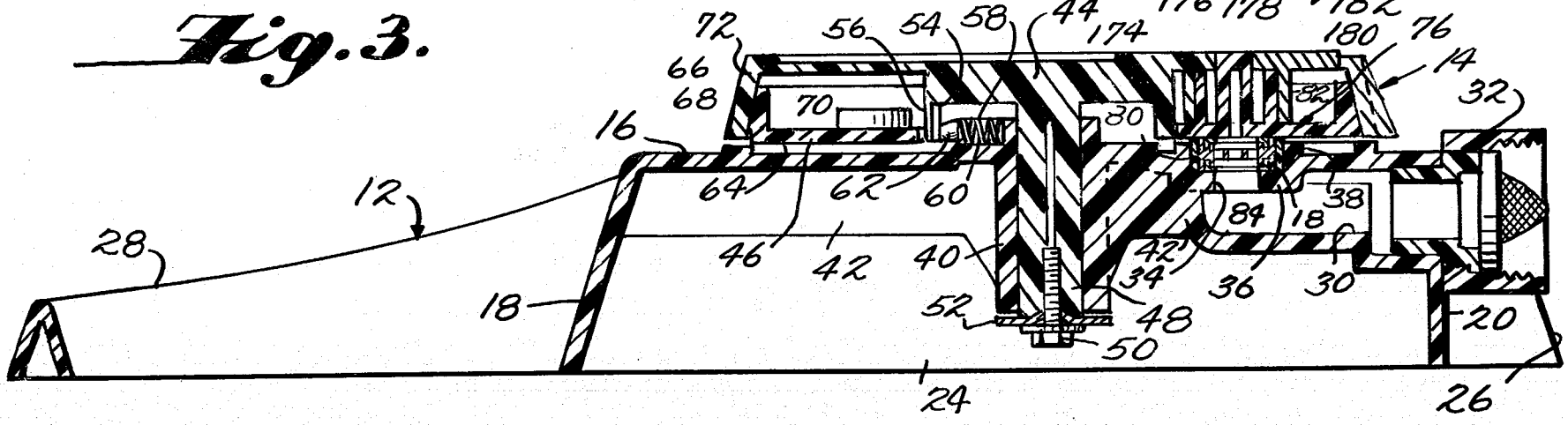
FIG. 3 is a sectional view taken along the line 3—3 of FIG. 1.
Figure 8:
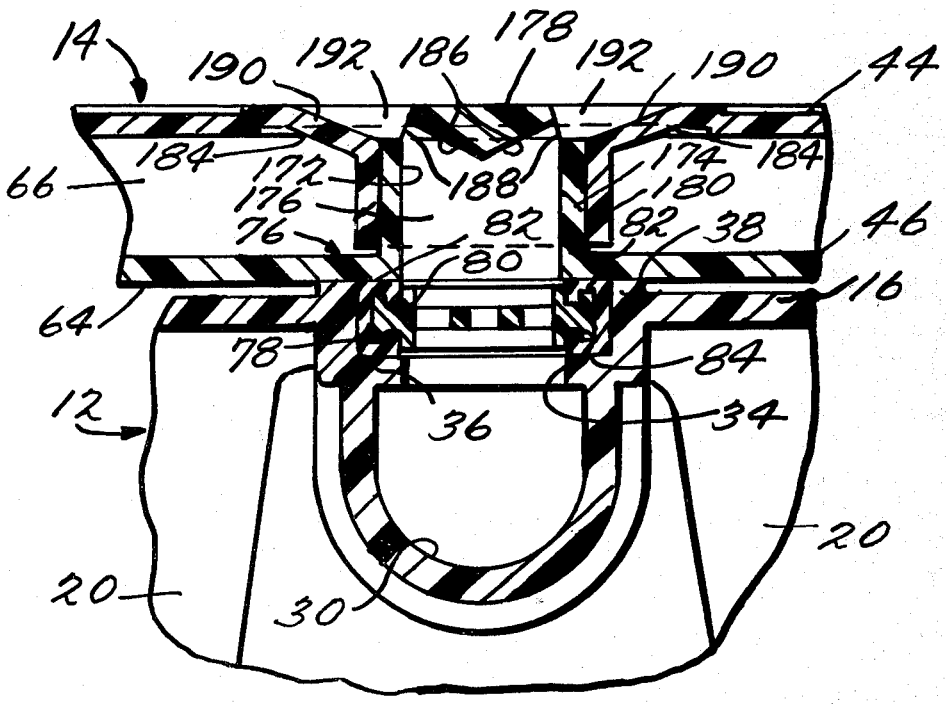
FIG. 8 is an enlarged fragmentary sectional view taken along the line 8—8 of FIG. 1.

An annular seal assembly, generally indicated at 76, is provided in the water outlet for purposes of effecting a seal on the downwardly facing planar surface 64 between the water outlet of the base and the inlet of the particular spray head structure which is in selected operative position. As best shown in FIGS. 3 and 8, the seal assembly 76 includes an annular seal 78 of resilient material and a rigid annular seal retainer 80. The seal retainer 80 includes an outer annular portion of generally H-shaped cross-sectional configuration and an inner open grate-like portion. The resilient annular seal 78 has a generally C-shaped cross-sectional configuration and is mounted in interfitting relation with the retainer 80 so that the ends of the C engage between the legs of the H. The seal assembly, consisting of the annular seal 78 and seal retainer 80 interfitted in the manner indicated above, is mounted within the interior peripheral surface of the cylindrical wall 38 of the base. The annular seal includes an upwardly facing generally flat sealing surface 82 which is positioned to sealingly engage the downwardly facing planar surface 64 of the turret assembly. The annular seal includes a lower generally convexly curved downwardly facing surface 84 positioned to be engaged by the upwardly facing surface of the annular wall 36. The vertical dimension of the annular seal 78 is such that when the turret assembly is operatively mounted on the base, the lower portion thereof defining the convexly curved surface 84 is deformed by engagement with annular wall 36 resulting in a deformed sealing engagement between the exterior surface of the annular seal and the interior periphery of the cylindrical wall 38 of the base. Accordingly, this exterior-interior peripheral sealing engagement in addition to the interengagement of the surface 84 and annular wall 36 insures against water leakage between the base and turret assembly. It will be understood, however, that other sealing arrangements may be utilized, if desired.

Figure 4:
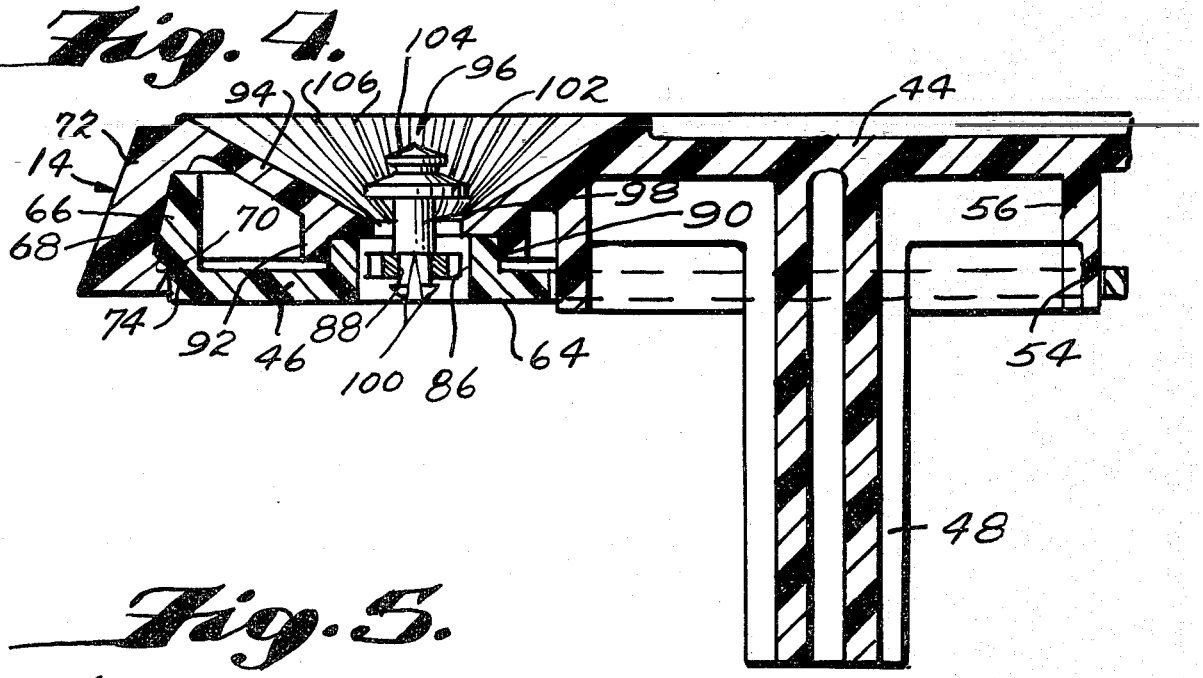
FIG. 4 is an enlarged fragmentary sectional view taken along the line 4—4 of FIG. 1.

As previously indicated, as shown there are five different spray head structures providing five different ground patterns, identified as circular, semi-circular, square, rectangular and strip. As best shown in FIGS. 1 and 4, the circular spray head structure provides an inlet extending upwardly from the surface 64 which includes a multiplicity of inlet passages 86 spaced annularly about a central opening 88. The opening and passages are formed by a spider-like integral portion formed within an upwardly extending cylindrical wall portion 90 in the lower annular member 46. The upper annular member 44 includes a depending cylindrical wall portion 92 which is disposed in telescopic engagement with the upstanding cylindrical wall portion 90.

The circular spray head structure provided in the upper annular member 44 includes a frustoconical wall portion 94 having a lower inner periphery which is disposed within the depending cylindrical wall and upper outer periphery which extends to the upper surface of the annular member. It can be seen that water flowing through the annularly spaced inlet passages 86 will flow upwardly through the inner periphery of the frustoconical wall portion 94 by virtue of the interengagement between the upstanding and depending cylindrical wall portions 90 and 92. This water is spread radially outwardly by a separate water spreading element, generally indicated at 96. As shown, the water spreading element includes a stem portion 98 having the lower extremity thereof bifurcated to form a pair of spring detent fingers 100. The arrangement is such that when the element 96 is pushed downwardly through the central opening 88, spring fingers 100 will be cammed inwardly to permit passage thereof through the opening. The stem portion is shouldered so that when the spring fingers pass through the opening they spring out and serve to fixedly retain the water spreading element 96 in axial alignment with the opening 88. The water spreading element 96 includes an enlarged head portion 102 having a downwardly facing annular surface which receives the water flowing upwardly through the inlet passages 86 and spreads the same radially outwardly. As shown, the water spreading element 96 includes an upper knob 104 which is provided primarily for the purpose of enabling the element to be more readily handled during assembly.

Formed in the upwardly open surface of the frustoconical wall portion 94 of the upper annular member 44 is a multiplicity of annularly spaced upwardly open generally straight grooves 106 extending upwardly and outwardly in a generally radial direction from a radially inward position below the downwardly facing surface of the enlarged head 102 of the water spreading element 96 to a radially outward position above the latter and coincident with the upper surface of the frustoconical wall portion 94. The grooves 106 receive the water which is spread radially outwardly by the water spreading element 96 and channel the same upwardly and outwardly in jet streams which pass from the ends of the grooves 106.

Figure 5:
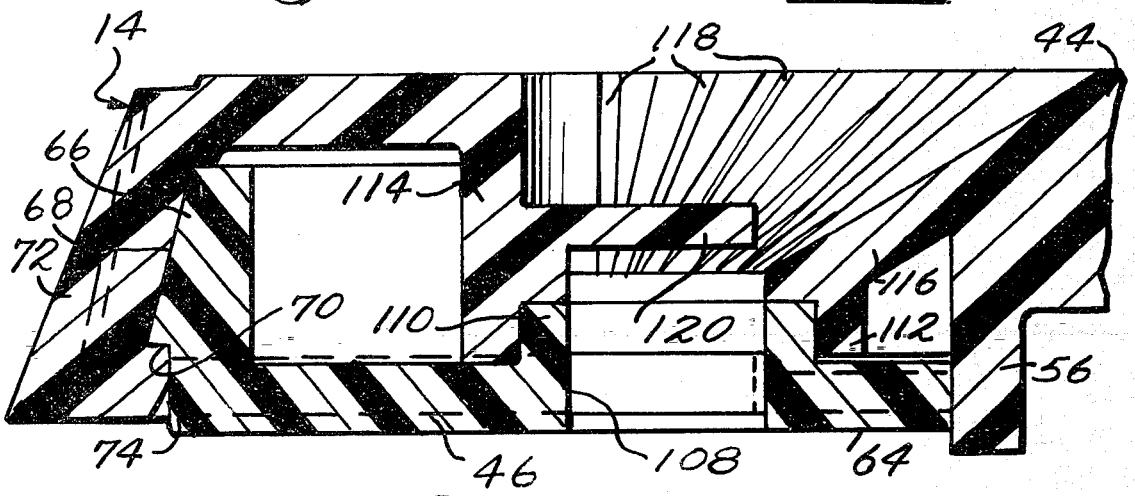
FIG. 5 is an enlarged fragmentary sectional view taken along the line 5—5 of FIG. 1.

Referring now more particularly to FIGS. 1 and 5, the semi-circular pattern spray head structure provides an inlet 108 extending upwardly from the downwardly facing planar surface 64 of the annular member 46. The upper portion of the inlet 108 is defined by the interior of a cylindrical wall portion 110 extending upwardly from the member 46. The upstanding cylindrical wall portion 110 fits telescopically within a depending cylindrical wall portion 112 formed in the upper annular member 44. Formed in the upper annular member 44 above the cylindrical wall portion 112 and inwardly of the interior periphery thereof is a vertical wall portion 114. A semi-frustoconical wall portion 116 joins with the ends of the vertical wall portion in surrounding relation to the inlet 108. The upwardly facing surface of the semi-frustoconical wall portion 116 is formed with a series of upwardly open annularly spaced straight grooves 118 which extend upwardly and outwardly from the upper end of the inlet 108 defined by the lower inner periphery of the semi-frustoconical wall portion 116 to the upper surface of the member 44 in a generally radial direction.

A water spreading structure is provided in the form of an integrally molded element 120 extending horizontally from the vertical wall portion 114 in a vertical position slightly above the lower inner ends of the grooves 118 and substantially below the upper outer ends thereof. It can be seen that water under pressure entering the inlet 108 from the base outlet 34 will pass upwardly into engagement with the downwardly facing surface of the water spreading element which is substantially horizontally coextensive therewith. As the water contacts the element 120 it is spread radially outwardly onto the semi-frustoconical wall 116 where it tends to channel within the grooves 118 so that, as before, by the time the water leaves the upper outer ends of the grooves it has been confined to a series of jet streams which fall onto the ground in a semi-circular pattern.

Figure 6:
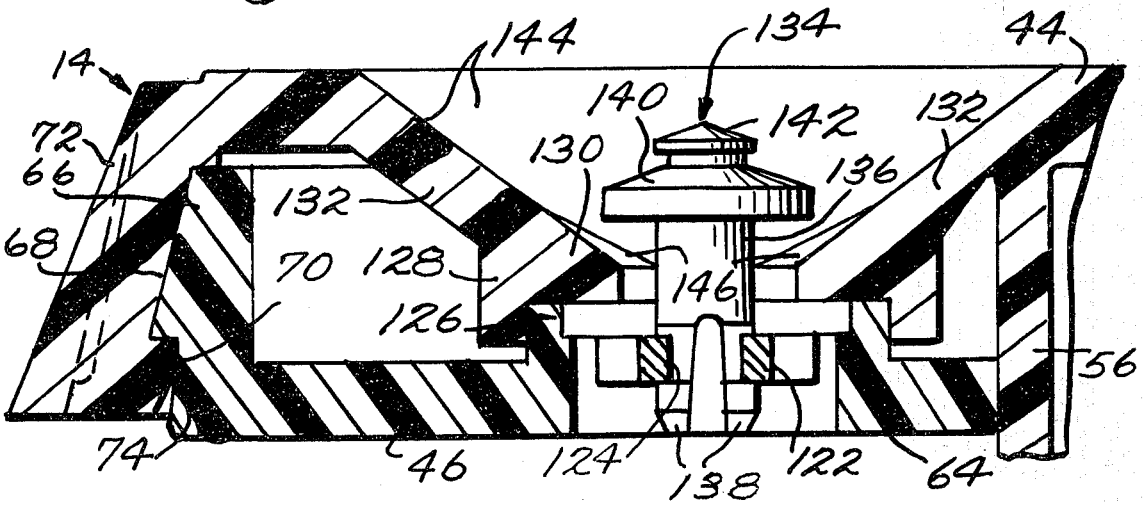
FIG. 6 is an enlarged fragmentary sectional view taken along the line 6—6 of FIG. 1.

Referring now more particularly to FIGS. 1 and 6, the square pattern spray head structure provides an inlet configuration similar to that provided by the circular pattern spray head structure which includes a plurality of inlet openings 122 spaced annularly about a central vertically extending opening 124. As shown, the openings 122 and 124 are defined by a spider-like structure integrally formed within a cylindrical wall portion 126 extending upwardly from the downwardly facing planar surface 64 of the lower annular member 46. The upstanding cylindrical wall portion 126 fits telescopically within a depending cylindrical wall portion 128 formed integrally on the upper annular member. Extending radially inwardly from the upper end of the cylindrical wall portion 128 is an integral annular wall portion 130, the interior periphery of which defines the upper end of the inlet of the spray head structure. Extending upwardly and outwardly from the juncture between the cylindrical wall portion 128 and annular wall portion 130 are four intersecting flat inclined integral wall portions 132.

The central opening 124 is adapted to receive a separate water spreading element, generally indicated at 134, similar to the separate water spreading element 96 previously described in connection with the circular pattern spray head structure. As before, the element 134 includes a stem portion 136, a pair of spring detent fingers 138 for retaining the stem portion with the opening 124, en enlarged head portion 140 having a downwardly facing annular water spreading surface, and an upper handling knob portion 142.

The inner annular wall portion 130 and the four intersecting upwardly and outwardly inclined wall portions 132 provide upwardly open pattern defining surfaces which include four generally upwardly facing planar surfaces 144 extending upwardly and outwardly from a radially inward position below the downwardly facing annular water spreading surface of the head portion 140 to a radially outward position above the latter and four lower relatively small, planar, transition surfaces 144. Each planar surface 144 intersects throughout a major upper extent thereof with two adjacent planar surfaces 144 and along a minor lower extent thereof with two associated transition surfaces 146. It will be understood that water under pressure from the base outlet will flow upwardly through outlet passages 122 into contact with the downwardly facing annular surface of the head portion 140 which serves to spread the same radially outwardly onto the planar surfaces 144. The water is directed upwardly and outwardly by the planar surfaces 144 and leaves the upper edges thereof in sheet formation to fall on the ground in a square pattern.

Figure 7:
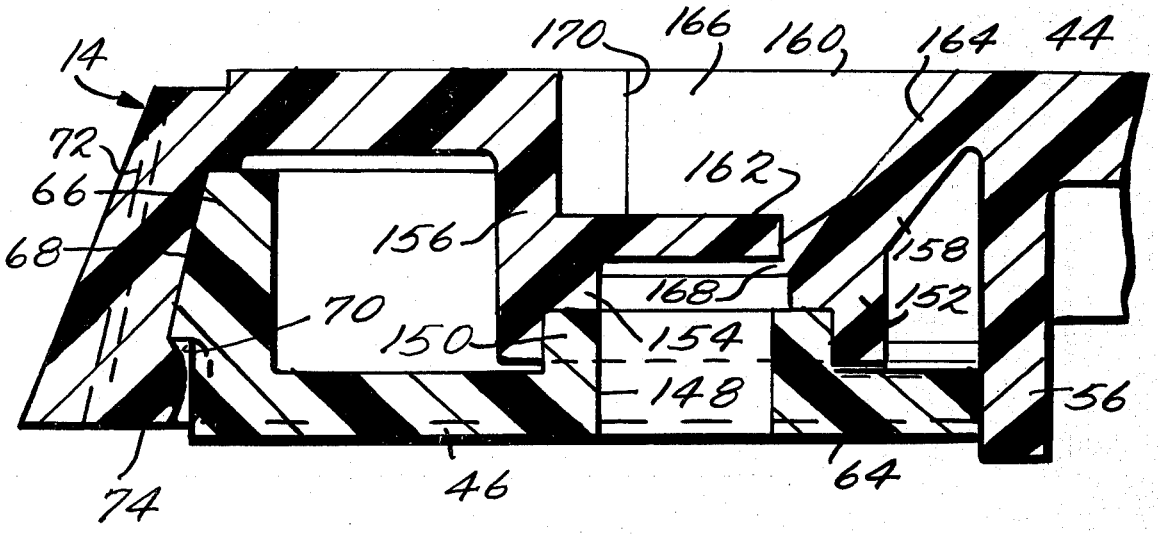
FIG. 7 is an enlarged fragmentary sectional view taken along the line 7—7 of FIG. 1.

Referring now more particularly to FIGS. 1 and 7, the rectangular pattern spray head structure provides a water inlet 148 in the form of the cylindrical interior periphery of a cylindrical wall portion 150 extending upwardly from the downwardly facing planar surface 64 of the lower annular member 46. The rectangular spray head structure bears a relationship to the square spray head structure which is similar to the relationship of the semi-circular spray head structure to the circular spray head structure. From the standpoint of the spray pattern itself this means that the rectangular pattern is one-half the square pattern.

As with the semi-circular spray head structure, the upstanding cylindrical wall portion 150 fits telescopically within a depending cylindrical wall portion 152 formed integrally on the upper annular member 44. An annular wall portion 154 extends inwardly from the upper end of the cylindrical wall portion and a vertical wall portion 156 extends upwardly from the annular wall portion at a position spaced slightly inwardly of its interior periphery. A full inclined flat wall portion 158 extends upwardly and outwardly from the annular wall portion 154 in diametrically opposed relation to the vertical wall portion 156 and two opposed half inclined flat wall portions 160 extend between the ends of the vertical wall portion 156 and the full inclined wall portion 158.

As with the semi-circular pattern spray head structure, an integral water spreading element 162 is provided in the form of a horizontally extending cantilevered wall portion integral with the vertical wall portion 156 at a position spaced slightly above the lower end thereof.

The vertical wall portion 156 above the water spreading element 162, the full inclined wall portion 158, the two half inclined wall portions 160 and the section of the annular wall coextensive with the inclined wall portions 158 and 160, provide upwardly open pattern defining surfaces which include a full planar surface 164, two inclined planar half surfaces 166, two small lower transition surfaces 168 and two vertical surfaces 170. As shown, the full planar surface extends upwardly and outwardly from a radially inward position below the downwardly facing water spreading surface of the water spreading element 162 to a radially outward position thereabove flush with the uppermost surface of the upper annular member 44. A major upper radial extent of the full inclined surface 164 intersects with each of the inclined half surfaces 166 which, in turn, also intersect with the two vertical surfaces 170 respectively. Each intersecting pair of full and half surfaces intersect along a minor lower extent thereof with a small transition surface 168.

It will be understood that water under under pressure flowing from the base outlet will pass upwardly through the water inlet 148 into contact with the water spreading element. The downwardly facing surface of the element 162 serves to spread the water generally horizontally outwardly onto the inclined surfaces 164 and 166 and transition surfaces. The water is directed by the vertical surfaces 170 to flow upwardly and outwardly along the inclined surfaces 164 and 166 to discharge from the upper edges thereof in sheet formation so as to fall on the ground in a rectangular pattern.

Referring now more particularly to FIGS. 1, 3 and 8, the strip pattern spray head structure provides a water inlet 172 of rectangular cross-sectional configuration which is defined at opposed ends by a cylindrical wall portion 174 extending upwardly from the downwardly facing surface 64 of the lower annular member 46. The opposed sides of the inlet 172 are defined by a pair of parallel vertical wall portions 176 extending upwardly from the downwardly facing surface 64 within the cylindrical wall portion 174. The upper marginal edges of the parallel wall portions 176 extend above the cylindrical wall portion 174 and are interconnected by an integral top wall 178.

The cylindrical wall portion 174 fits telescopically within a depending cylindrical wall portion 180 formed integrally on the upper annular member 44. A pair of diametrically opposed flat planar wall portions 182 extend horizontally toward one another over the upper edge of the cylindrical wall portion 180 and two inclined flat wall portions 184 extend upwardly and outwardly from the upper edge of cylindrical wall portion 180 between the horizontal wall portions 182.

The top wall 178 has interior water engaging surfaces in the form of a pair of oppositely inclined planar surfaces 186 which face generally downwardly in a position to be contacted by the water flowing upwardly through the water inlet 172. The downwardly facing surfaces 186 serve to direct the water generally horizontally outwardly in opposite directions and slightly upwardly through jet defining openings 188. Extending upwardly and outwardly from a position slightly below the jet defining openings 188 is a pair of inclined planar surfaces 190 which extend horizontally outwardly in opposed directions and slightly upwardly. The surfaces 190 are upwardly open and on the inclined wall portions 184 of the upper annular member 44. The inner edges of the horizontal wall portions 182 provide opposed vertical surfaces 192 which define the sides of the planar surfaces 190. Each planar surface 190 is positioned with respect to the jet issuing from the associated jet defining opening 188 so as to engage the lower portion of the jet. Such engagement can occur as a result of a Coanda effect. The engagement causes the lower portion of the jet to loose its integrity with respect to the remainder of the jet so that as the jet proceeds outwardly beyond the surface 190 the lower portion of the jet will progressively fall out and establish a relatively even distribution pattern along the ground which is in strip formation.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A turret type sprinkler comprising a base having inlet hose fitting means for connection with a hose communicating with a source of water under pressure, a turret assembly mounted on said base for indexed rotational movement about a generally vertical axis, said turret assembly including upper and lower cooperating annular members and means for fixedly securing said annular members in cooperating relation with respect to one another, said annular members when in cooperating relation providing a plurality of spray head structures spaced annularly about the axis of indexed rotation thereof, said lower annular member having a downwardly facing annular planar surface, said base having water outlet means disposed in water communicating relation with said inlet hose fitting means for directing a source of water communicated with the latter in an upward direction in sealed relation with said downwardly facing annular surface, each of said spray head structures including water inlet means extending upwardly from the downwardly facing annular surface of said lower annular member in a position to be communicated with the water outlet means of said base in one operative position of indexed rotation of said turret assembly with respect to said base, each of said spray structures also including upwardly open pattern defining surfaces formed in said upper annular member and extending upwardly and outwardly with respect to the associated water inlet means, said pattern defining surfaces being different for each spray head structure so that the ground pattern desired can be selected by moving said turret assembly into an indexed position in which the water inlet means of the spray head structure having the corresponding pattern defining surfaces are in said operative position with respect to the water outlet means of said base, one of said spray head structures comprising a water spreading element formed as an integral part of said upper annular member extending generally horizontally over the associated water inlet means, said last-mentioned water spreading element providing generally downwardly facing surface means for spreading the water passing upwardly through the associated water inlet means in a generally radially outward direction within an annular extent of approximately 180°, the pattern defining surfaces of the last-mentioned spray head structure including three generally upwardly facing planar surfaces extending upwardly and outwardly from a radially inward position relatively slightly below the downwardly facing surface means of the associated water spreading element to a radially outward position relatively slightly above the downwardly facing surface means of the associated water spreading element, said three planar surfaces being arranged with a central one of a size equal to the combined size of the other two intersecting the other two along upwardly and outwardly extending lines so that the water spread radially outwardly by the downwardly facing surface means of the associated water spreading element is received on said three planar surfaces and directed thereby from the radially outward ends thereof as sheets of water which fall on the ground in a generally rectangular pattern.

2. A turret type sprinkler comprising a base having inlet hose fitting means for connection with a hose communicating with a source of water under pressure, a turret assembly mounted on said base for indexed rotational movement about a generally vertical axis, said turret assembly including upper and lower cooperating annular members and means for fixedly securing said annular members in cooperating relation with respect to one another, said annular members when in cooperating relation providing a plurality of spray head structures spaced annularly about the axis of indexed rotation thereof, said lower annular member having a downwardly facing annular planar surface, said base having water outlet means disposed in water communicating relation with said inlet hose fitting means for directing a source of water communicated with the latter in an upward direction in sealed relation with said downwardly facing annular surface, each of said spray head structures including water inlet means extending upwardly from the downwardly facing annular surface of said lower annular member in a position to be communicated with the water outlet means of said base in one operative position of indexed rotation of said turret assembly with respect to said base, each of said spray structures also including upwardly open pattern defining surfaces formed in said upper annular member and extending upwardly and outwardly with respect to the associated water inlet means, said pattern defining surfaces being different for each spray head structure so that the ground pattern desired can be selected by moving said turret assembly into an indexed position in which the water inlet means of the spray head structure having the corresponding pattern defining surfaces are in said operative position with respect to the water outlet means of said base, the water inlet means associated with one of said spray head structures comprising a plurality of generally parallel water inlet passages spaced annularly about a central vertically extending opening, said last mentioned spray head structure including a water spreading element having a stem portion mounted within said opening and an enlarged annular head portion extending radially outwardly from the upper end of said stem portion, the head portion of the associated water spreading element including a frustoconical wall having a generally downwardly facing annular surface means for spreading the water passing upwardly through the associated inlet passages in a generally radially outward direction, the pattern defining surfaces of said last-mentioned spray head structure defining a multiplicity of annularly spaced upwardly open generally straight grooves extending straight upwardly and straight outwardly in a generally radial direction from a radially inward position spaced relatively slightly below and radially inwardly of the downwardly facing surface means of the associated water spreading element to a radially outward position spaced relatively greatly above and radially outwardly of the downwardly facing surface means of the associated water spreading element whereby the water spread radially outwardly by the latter is received within said grooves and directed thereby from the radially outward ends thereof as a multiplicity of jet streams which fall on the ground in a generally circular pattern.

3. A turret type sprinkler comprising a base having inlet hose fitting means for connection with a hose communicating with a source of water under pressure, a turret assembly mounted on said base for indexed rotational movement about a generally vertical axis, said turret assembly including upper and lower cooperating annular members and means for fixedly securing said annular members in cooperating relation with respect to one another, said annular members when in cooperating relation providing a plurality of spray head structures spaced annularly about the axis of indexed rotation thereof, said lower annular member having a downwardly facing annular planar surface, said base having water outlet means disposed in water communicating relation with said inlet hose fitting means for directing a source of water communicated with the latter in an upward direction in sealed relation with said downwardly facing annular surface, each of said spray head structures including water inlet means extending upwardly from the downwardly facing annular surface of said lower annular member in a position to be communicated with the water outlet means of said base in one operative position of indexed rotation of said turret assembly with respect to said base, each of said spray structures also including upwardly open pattern defining surfaces formed in said upper annular member and extending upwardly and outwardly with respect to the associated water inlet means, said pattern defining surfaces being different for each spray head structure so that the ground pattern desired can be selected by moving said turret assembly into an indexed position in which the water inlet means of the spray head structure having the corresponding pattern defining surfaces are in said operative position with respect to the water outlet means of said base, the water inlet means associated with one of said spray head structures comprising a plurality of generally parallel water inlet passages spaced annularly about a central vertically extending opening, said last-mentioned spray head structure including a water spreading element having a stem portion mounted within said opening and an enlarged annular head portion extending radially outwardly from the upper end of said stem portion, the head portion of the associated water spreading element having generally downwardly facing annular surface means for spreading the water passing upwardly through the associated inlet passages in a generally radially outward direction, the pattern defining surfaces of said last-mentioned spray head structure including four generally upwardly facing planar surfaces extending upwardly and outwardly from a radially inward position relatively slightly below the downwardly facing surface means of the associated water spreading element to a radially outward position relatively slightly above said downwardly facing surface means of the associated water spreading element, each of said four planar surfaces being arranged to intersect with two adjacent planar surfaces along upwardly and outwardly extending lines so that the water spread radially outwardly by the downwardly facing surface means of the associated water spreading element is received on said four planar surfaces and directed thereby from the radially outward ends thereof as sheets of water which fall on the ground in a generally square pattern.

4. A turret type sprinkler comprising a base having inlet hose fitting means for connection with a hose communicating with a source of water under pressure, a turret assembly mounted on said base for indexed rotational movement about a generally vertical axis, said turret assembly including upper and lower cooperating annular members and means for fixedly securing said annular members in cooperating relation with respect to one another, said annular members when in cooperating relation providing a plurality of spray head structures spaced annularly about the axis of indexed rotation thereof, said lower annular member having a downwardly facing annular planar surface, said base having water outlet means disposed in water communicating relation with said inlet hose fitting means for directing a source of water communicated with the latter in an upward direction in sealed relation with said downwardly facing annular surface, each of said spray head structures including water inlet means extending upwardly from the downwardly facing annular surface of said lower annular member in a position to be communicated with the water outlet means of said base in one operative position of indexed rotation of said turret assembly with respect to said base, each of said spray structures also including upwardly open pattern defining surfaces formed in said upper annular member and extending upwardly and outwardly with respect to the associated water inlet means, said pattern defining surfaces being different for each spray head structure so that the ground pattern desired can be selected by moving said turret assembly into an indexed position in which the water inlet means of the spray head structure having the corresponding pattern defining surfaces are in said operative position with respect to the water outlet means of said base, one of said spray head structures comprising a water spreading element formed as an integral part of said upper annular member extending generally horizontally over the associated water inlet means, said last-mentioned water spreading element providing generally downwardly facing surface means for spreading the water passing upwardly through the associated water inlet means in a generally radially outward direction within an annular extent of approximately 180°, the pattern defining surfaces of the lastmentioned spray head structure defining a multiplicity of upwardly open generally straight grooves spaced annularly within an annular extent of approximately 180° extending straight upwardly and straight outwardly in a generally radial direction from a radially inward position below the downwardly facing surface means of the associated water spreading element to a radially outward position above the downwardly facing surface means of the associated water spreading element whereby the water spread radially outwardly by the latter is received within said grooves and directed thereby from the radially outward ends thereof as a multiplicity of jet streams which fall on the ground in a generally semi-circular pattern.

5. A turret type sprinkler as defined in claim 2, 3 or 4 wherein a one of said spray head structures comprises a water spreading element formed as an integral part of said upper annular member extending generally horizontally over the associated water inlet means, said last-mentioned water spreading element providing generally downwardly facing surface means for spreading the water passing upwardly through the associated water inlet means in a generally radially outward direction within an annular extent of approximately 180°, the pattern defining surfaces of the lastmentioned spray head structure including three generally upwardly facing planar surfaces extending upwardly and outwardly from a radially inward position relatively greatly below the downwardly facing surface means of the associated water spreading element to a radially outward position relatively greatly above the downwardly facing surface means of the associated water spreading element, said three planar surfaces being arranged with a central one of a size equal to the combined size of the other two intersecting the other two along upwardly and outwardly extending lines so that the water spread radially outwardly by the downwardly facing surface means of the associated water spreading element is received on said three planar surfaces and directed thereby from the radially outward ends thereof as sheets of water which fall on the ground in a generally rectangular pattern.

6. A turret type sprinkler as defined in claim 3 or 4 wherein the water inlet means associated with one of said spray head structures comprises a plurality of generally parallel water inlet passages spaced annularly about a central vertically extending opening, said last mentioned spray head structure including a water spreading element having a stem portion mounted within said opening and an enlarged annular head portion extending radially outwardly from the upper end of said stem portion, the head portion of the associated water spreading element including a frustoconical wall having generally downwardly facing annular surface means for spreading the water passing upwardly through the associated inlet passages in a generally radially outward direction, the pattern defining surfaces of said lastmentioned spray head structure defining a multiplicity of annularly spaced upwardly open generally straight grooves extending straight upwardly and straight outwardly in a generally radial direction from a radially inward position spaced relatively slightly below and relatively inwardly of the downwardly facing surface means of the associated water spreading element to a radially outward position spaced relatively greatly above and radially outwardly of the downwardly facing surface means of the associated water spreading element whereby the water spread radially outwardly by the latter is received within said grooves and directed thereby from the radially outward ends thereof as a multiplicity of jet streams which fall on the ground in a generally circular pattern.

7. A turret type sprinkler as defined in claim 4 wherein the water inlet means associated with one of said spray head structures comprises a plurality of generally parallel water inlet passages spaced annularly about a central vertically extending opening, said last-mentioned spray head structure including a water spreading element having a stem portion mounted within said opening and an enlarged annular head portion extending radially outwardly from the upper end of said stem portion, the head portion of the associated water spreading element having generally downwardly facing annular surface means for spreading the water passing upwardly through the associated inlet passages in a generally radially outward direction, the pattern defining surfaces of said lastmentioned spray head structure including four generally upwardly facing planar surfaces extending upwardly and outwardly from a radially inward position relatively slightly below the downwardly facing surface means of the associated water spreading element to a radially outward position relatively greatly above said downwardly facing surface means of the associated water spreading element, each of said four planar surfaces being arranged to intersect with two adjacent planar surfaces along upwardly and outwardly extending lines so that the water spread radially outwardly by the downwardly facing surface means of the associated water spreading element is received on said four planar surfaces and directed thereby from the radially outward ends thereof as sheets of water which fall on the ground in a generally square pattern.

8. A turret type sprinkler as defined in claim 7 wherein the water inlet means associated with one of said spray head structures comprises a plurality of generally parallel water inlet passages spaced annularly about a central vertically extending opening, said last mentioned spray head structure including a water spreading element having a stem portion mounted within said opening and an enlarged annular head portion extending radially outwardly from the upper end of said stem portion, the head portion of the associated water spreading element including a frustoconical wall having generally downwardly facing annular surface means for spreading the water passing upwardly through the associated inlet passages in a generally radially outward direction, the pattern defining surfaces of said last-mentioned spray head structure defining a multiplicity of annularly spaced upward open generally straight grooves extending straight upwardly and straight outwardly in a generally radial direction from a radially inward position spaced relatively slightly below and radially inwardly of the downwardly facing surface means of the associated water spreading element to a radially outward position spaced relatively greatly above and radially outwardly of the downwardly facing surface means of the associated water spreading element whereby the water spread radially outwardly by the latter is received within said grooves and directed thereby from the radially outward ends thereof as a multiplicity of jet streams which fall on the ground in a generally circular pattern.

9. A turret type sprinkler as defined in claim 7 or 8 wherein one of said spray head structures comprises a water spreading element formed as an integral part of said upper annular member extending generally horizontally over the associated water inlet means, said last-mentioned water spreading element providing generally downwardly facing surface means for spreading the water passing upwardly through the associated water inlet means in a generally radially outward direction within an annular extent of approximately 180°, the pattern defining surfaces of the lastmentioned spray head structure including three generally upwardly facing planar surfaces extending upwardly and outwardly from a radially inward position relatively slightly below the downwardly facing surface means of the associated water spreading element to a radially outward position relatively greatly above the downwardly facing surface means of the associated water spreading element, said three planar surfaces being arranged with a central one of a size equal to the combined size of the other two intersecting the other two along upwardly and outwardly extending lines so that the water spread radially outwardly by the downwardly facing surface means of the associated water spreading element is received on said three planar surfaces and directed thereby from the radially outward ends thereof as sheets of water which fall on the ground in a generally rectangular pattern.

10. A turret type sprinkler as defined in claim 1, 2, 3, 4, 7 or 8 wherein one of said spray head structures comprises interior water engaging surface means for receiving the water from said inlet and directing the same in two jets extending horizontally outwardly in opposed directions and slightly upwardly, the pattern defining surfaces of the last mentioned spray head structure including two diametrically opposed inclined planar surfaces extending horizontally outwardly in opposed directions and slightly upwardly each in a position such that the lower portion of an associated jet engages the same so as to cause the lower portion of the associated jet to loose its integrity with the remainder of the jet and to progressively fall out along the ground in a strip pattern as the associated jet moves outwardly beyond the associated planar surface.

11. A turret type sprinkler as defined in claim 1, 2, 3, 4, or 7 wherein each of said spray head structures includes an upwardly extending cylindrical wall formed in the lower annular member in surrounding relation to the associated water inlet means thereof and an axially aligned cylindrical wall extending downwardly from said upper annular member, the upwardly extending and downwardly extending cylindrical walls associated with each spray head structure being disposed in telescoping engaged relation with respect to each other when said annular members are disposed in cooperating relation to one another so as to provide alignment and sealing engagement between said upper and lower members.

12. A turret type sprinkler as defined in claim 1, 2, 3, 4, 7 or 8 wherein said means for fixedly securing said annular members comprises an upwardly extending peripheral rim on the lower annular member defining a downwardly facing peripheral annular groove, a downwardly extending peripheral skirt on said upper annular member, the lower interior of said peripheral skirt having integral locking means for engaging said annular groove when said annular members are disposed in cooperating relation.

13. A spray head for distributing water in a circular ground pattern comprising a spray head structure having a central generally vertically extending opening therein and a plurality of generally parallel water inlet passages spaced annularly about said central opening, and a water spreading element including a stem portion mounted within said opening and an enlarged annular head portion extending radially outwardly from the upper end of said stem portion, said head portion including a frustoconical wall having generally downwardly facing annular surface means for spreading the water passing upwardly through said inlet passages in a generally radially outward direction, said spray head structure providing a multiplicity of annularly spaced upward open generally straight grooves extending straight upwardly and straight outwardly in a generally radial direction from a radially inward position spaced relatively slightly below and relatively inwardly of said downwardly facing surface means to a radially outward position spaced relatively greatly above and radially outwardly of said downwardly facing surface means whereby the water spread radially outwardly by the latter is received within said grooves and directed thereby from the radially outward ends thereof as a multiplicity of jet streams which fall on the ground in a generally circular pattern.

14. A spray head for distributing water in a square ground pattern comprising a spray head structure having a central generally vertically extending opening therein and a plurality of generally parallel water inlet passages spaced annularly about said central opening, and a water spreading element including a stem portion mounted within said opening and an enlarged annular head portion extending radially outwardly from the upper end of said stem portion, said head portion having generally downwardly facing annular surface means for spreading the water passing upwardly through said inlet passages in a generally radially outward direction, said spray head structure providing four generally upwardly facing planar surfaces extending upwardly and outwardly from a radially inward position relatively slightly below said downwardly facing surface means to a radially outward position relatively greatly above said downwardly facing surface means, each of said four planar surfaces being arranged to intersect with two adjacent planar surfaces along upwardly and outwardly extending lines so that the water spread radially outwardly by the said downwardly facing surface means is received on said four planar surfaces and directed thereby from the radially outward ends thereof as sheets of water which fall on the ground in a generally square pattern.

15. A spray head for distributing water in a semi-circular ground pattern comprising a spray head structure having a generally vertically extending water inlet, a water spreading element extending generally horizontally over said water inlet providing generally downwardly facing surface means for spreading the water passing upwardly through said water inlet in a generally radially outward direction within an annular extent of approximately 180°, and a multiplicity of upwardly open generally straight grooves spaced annularly within an annular extent of approximately 180° extending straight upwardly and straight outwardly in a generally radial direction from a radially inward position spaced relatively slightly below and relatively inwardly of said downwardly facing surface means to a radially outward position spaced relatively greatly above and radially outwardly of said downwardly facing surface means whereby the water spread radially outwardly by the latter is received within said grooves and directed thereby from the radially outward ends thereof as a multiplicity of jet streams which fall on the ground in a generally semi-circular pattern.

16. A spray head for distributing water in a rectangular ground pattern comprising a spray head structure having a generally vertically extending water inlet, a water spreading element extending generally horizontally over said water inlet providing generally downwardly facing surface means for spreading the water passing upwardly through said water inlet in a generally radially outward direction within an annular extent of approximately 180°, and three generally upwardly facing planar surfaces extending upwardly and outwardly from a radially inward position relatively slightly below said downwardly facing surface means to a radially outward position relatively greatly above said downwardly facing surface means, said three planar surfaces being arranged with a central one of a size equal to the combined size of the other two intersecting the other two along upwardly and outwardly extending lines so that the water spread radially outwardly by said downwardly facing surface means is received on said three planar surfaces and directed thereby from the radially outward ends thereof as sheets of water which fall on the ground in a generally rectangular pattern.

17. A spray head for distributing water in a strip ground pattern comprising a spray head structure having a generally vertically extending water inlet, interior water engaging surface means for receiving the water from said inlet and directing the same in at least one jet extending horizontally outwardly and slightly upwardly, and an upwardly open pattern defining surface means disposed in a position such that the lower portion of the jet engages the same so as to cause the lower portion of the jet to lose its integrity with the remainder of the jet and to progressively fall out along the ground in a strip pattern as the jet moves outwardly beyond said pattern defining surface means.

18. A spray head as defined in claim 17 wherein the interior water engaging surface means define a pair of jets extending horizontally outwardly in opposed directions and slightly upwardly and said upwardly open pattern defining surface means includes a pair of inclined planar surfaces extending horizontally outwardly in opposed directions and slightly upwardly each in a position such that the lower portion of an associated jet engages the same so as to cause the lower portion of the associated jet to lose its integrity with the remainder of the jet and to progressively fall out along the ground in a strip pattern as the associated jet moves outwardly beyond the associated planar surface.

19. A spray head as defined in claim 17 or 18 wherein said interior water engaging surface means is configured to define a jet having a width less than the width of the associated open pattern defining surface means.

20. A turret type sprinkler comprising a base having inlet hose fitting means for connection with a hose communicating with a source of water under pressure, a turret assembly mounted on said base for indexed rotational movement about a generally vertical axis, said turret assembly including upper and lower cooperating annular members and means for fixedly securing said annular members in cooperating relation with respect to one another, said annular members when in cooperating relation providing a plurality of spray head structures spaced annularly about the axis of indexed rotation thereof, said lower annular members having a downwardly facing annular planar surface, said base having water outlet means disposed in water communicating relation with said inlet hose fitting means for directing a source of water communicated with the latter in an upward direction in sealed relation with said downwardly facing annular surface, each of said spray head structures including water inlet means extending upwardly from the downwardly facing annular surface of said lower annular member in a position to be communicated with the water outlet means of said base in one operative position of indexed rotation of said turret assembly with respect to said base, each of said spray structures also including upwardly open pattern defining surfaces formed in said upper annular member and extending upwardly and outwardly with respect to the associated water inlet means, said pattern defining surfaces being different for each spray head structure so that the ground pattern desired can be selected by moving said turret assembly into an indexed position in which the water inlet means of the spray head structure having the corresponding pattern defining surfaces are in said operative position with respect to the water outlet means of said base, one of said spray head structures comprising interior water engaging surface means for receiving the water from said inlet and directing the same in two jets extending horizontally outwardly in opposed directions and slightly upwardly, the pattern defining surfaces of the last mentioned spray head structure including two diametrically opposed inclined planar surfaces extending horizontally outwardly in opposed directions and slightly upwardly each in a position such that the lower portion of an associated jet engages the same so as to cause the lower portion of the associated jet to loose its integrity with the remainder of the jet and to progressively fall out along the ground in a strip pattern as the associated jet moves outwardly beyond the associated planar surface.

21. A turret type sprinkler comprising a base having inlet hose fitting means for connection with a hose communicating with a source of water under pressure, a turret assembly mounted on said base for indexed rotational movement about a generally vertical axis, said turret assembly including upper and lower cooperating annular members and means for fixedly securing said annular members in cooperating relation with respect to one another, said annular members when in cooperating relation providing a plurality of spray head structures spaced annularly about the axis of indexed rotation thereof, said lower annular member having a downwardly facing annular planar surface, said base having water outlet means disposed in water communicating relation with said inlet hose fitting means for directing a source of water communicated with the latter in an upward direction in sealed relation with said downwardly facing annular surface, each of said spray head structures including water inlet means extending upwardly from the downwardly facing annular surface of said lower annular member in a position to be communicated with the water outlet means of said base in one operative position of indexed rotation of said turret assembly with respect to said base, each of said spray structures also including upwardly open pattern defining surfaces formed in said upper annular member and extending upwardly and outwardly with respect to the associated water inlet means, said pattern defining surfaces being different for each spray head structure so that the ground pattern desired can be selected by moving said turret assembly into an indexed position in which the water inlet means of the spray head structure having the corresponding pattern defining surfaces are in said operative position with respect to the water outlet means of said base, said means for fixedly securing said annular members comprising an upwardly extending peripheral rim on the lower annular member defining a downwardly facing peripheral annular groove, a downwardly extending peripheral skirt on said upper annular member, the lower interior of said peripheral skirt having integral locking means for engaging said annular groove when said annular members are disposed in cooperating relation.

* * * * *